United States Patent [19]

Nissen

[11] 4,253,529

[45] Mar. 3, 1981

[54] SUPPORT STRUCTURE FOR DOZER BLADE

[75] Inventor: Roland N. Nissen, Wichita, Kans.

[73] Assignee: J. I. Case Company, Racine, Wis.

[21] Appl. No.: 950,594

[22] Filed: Oct. 12, 1978

[51] Int. Cl.[3] ..... E02F 3/76

[52] U.S. Cl. ..... 172/831; 172/818

[58] Field of Search ..... 172/809, 801, 803, 804, 172/806, 807, 805, 484, 307

[56] References Cited

U.S. PATENT DOCUMENTS

| | | | |
|---|---|---|---|
| 2,565,337 | 8/1951 | Allan | 172/804 |
| 2,722,066 | 11/1955 | Wills | 172/484 |
| 3,116,797 | 1/1964 | Launder | 172/484 |
| 3,226,860 | 1/1966 | McGee | 172/806 X |
| 3,759,110 | 9/1973 | Davis | 172/805 |
| 3,913,684 | 10/1975 | Casey | 172/307 |

FOREIGN PATENT DOCUMENTS

| | | | |
|---|---|---|---|
| 951865 | 3/1964 | United Kingdom | 172/484 |

*Primary Examiner*—Richard J. Johnson

*Attorney, Agent, or Firm*—Dressler, Goldsmith, Shore, Sutker & Milnamow, Ltd.

[57] ABSTRACT

A mounting structure for a dozer frame having a dozer blade supported thereon consists of a pair of rigid links of equal length which are pivotally connected at vertically spaced pivot points on a vehicle frame and have free ends connected to the mounting frame at vertically spaced locations. The spacing between the pivot axes on the mounting frame and the vehicle frame are substantially equal so that the blade does not tilt when moved between raised and lowered positions.

3 Claims, 2 Drawing Figures

SUPPORT STRUCTURE FOR DOZER BLADE

BACKGROUND OF THE INVENTION

The present invention is directed to an improvement in blade mounting assemblies and more particularly to an improved support structure for mounting a dozer frame which supports a dozer blade of the type disclosed in Davis, U.S. Pat. No. 3,759,110, assigned to the assignee of the present invention.

This patent discloses a unique manner of supporting a dozer blade on a dozer frame which is capable of automatically shifting the dozer blade laterally as well as angling the blade with respect to the longitudinal axis of the vehicle. The blade can also be shifted longitudinally of the vehicle during operation and can be moved towards the vehicle so as to be in close proximity to the wheels in a transport position.

In the arrangement disclosed in the Davis patent, the mounting frame is supported on a vertical column and can be shifted along the vertical column to raise and lower the blade with respect to the ground.

The structure disclosed in the Davis patent has been accepted in the industry and has been used on a commercial basis for a number of years.

One of the shortcomings that has been detected in the system of supporting the dozer blade that is disclosed in the Davis patent is that the mounting structure for supporting the dozer frame on the vehicle is fairly expensive adding to the overall cost of the vehicle.

SUMMARY OF THE INVENTION

According to the present invention, a mounting structure for a dozer frame that has a dozer blade supported thereon consists of a pair of parallel links that are pivoted on the vehicle frame at vertically spaced locations and are also pivoted on the dozer frame at vertically spaced locations.

The rigid links are substantially equal in length and the pivot axes on the dozer frame and the vehicle frame are located in substantially vertical planes that extend parallel to each other so there is no tilting of the dozer blade as the unit is moved between the raised and lowered positions.

DETAILED DESCRIPTION

Figure 1:
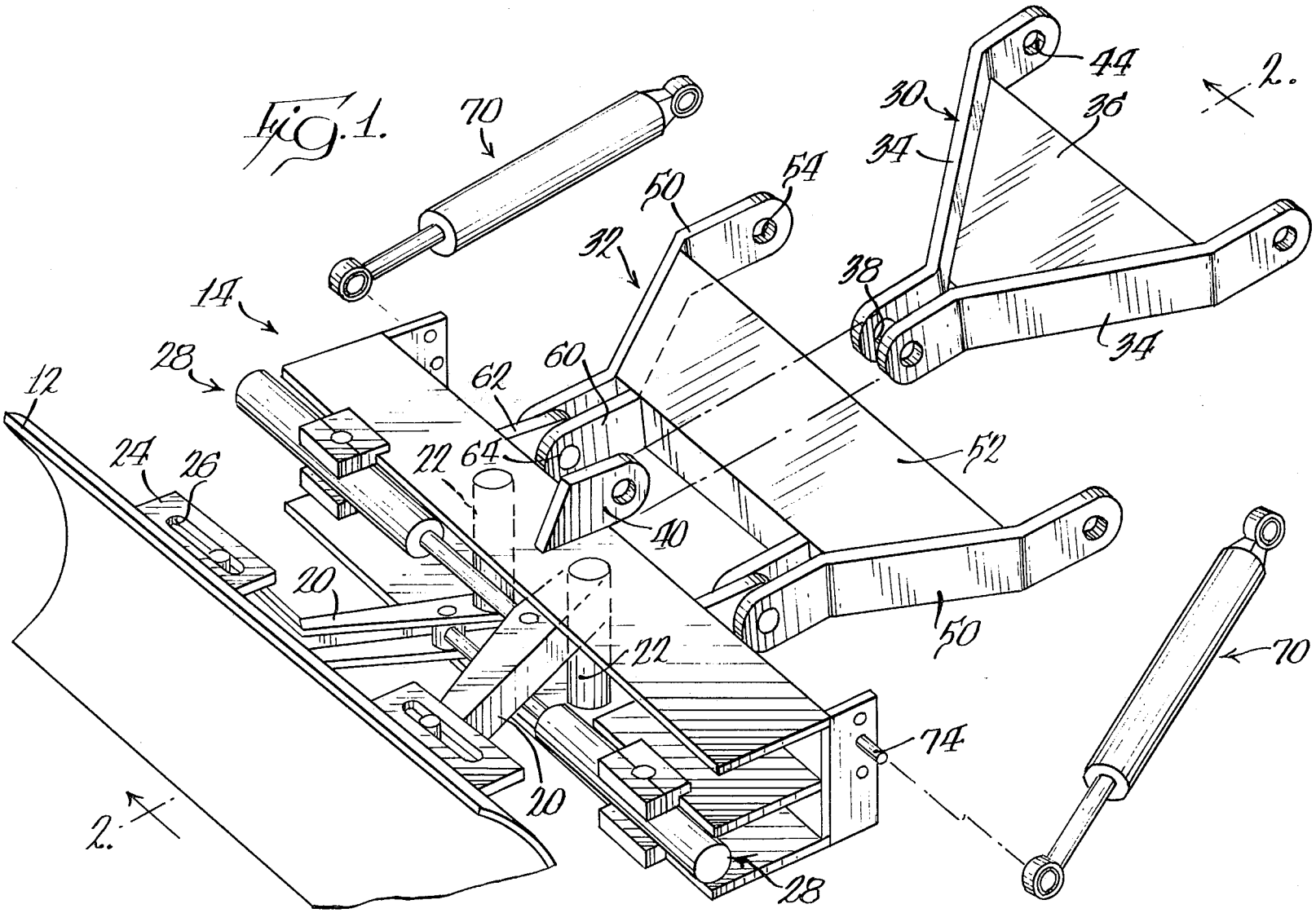
FIG. 1 is an exploded perspective view of the mounting arrangement for a dozer blade.

While this invention is susceptible of embodiment in many different forms, there is shown in the drawings and will herein be described in detail a preferred embodiment of the invention with the understanding that the present disclosure is to be considered as an exemplification of the principles of the invention and is not intended to limit the invention to the embodiment illustrated.

Figure 2:
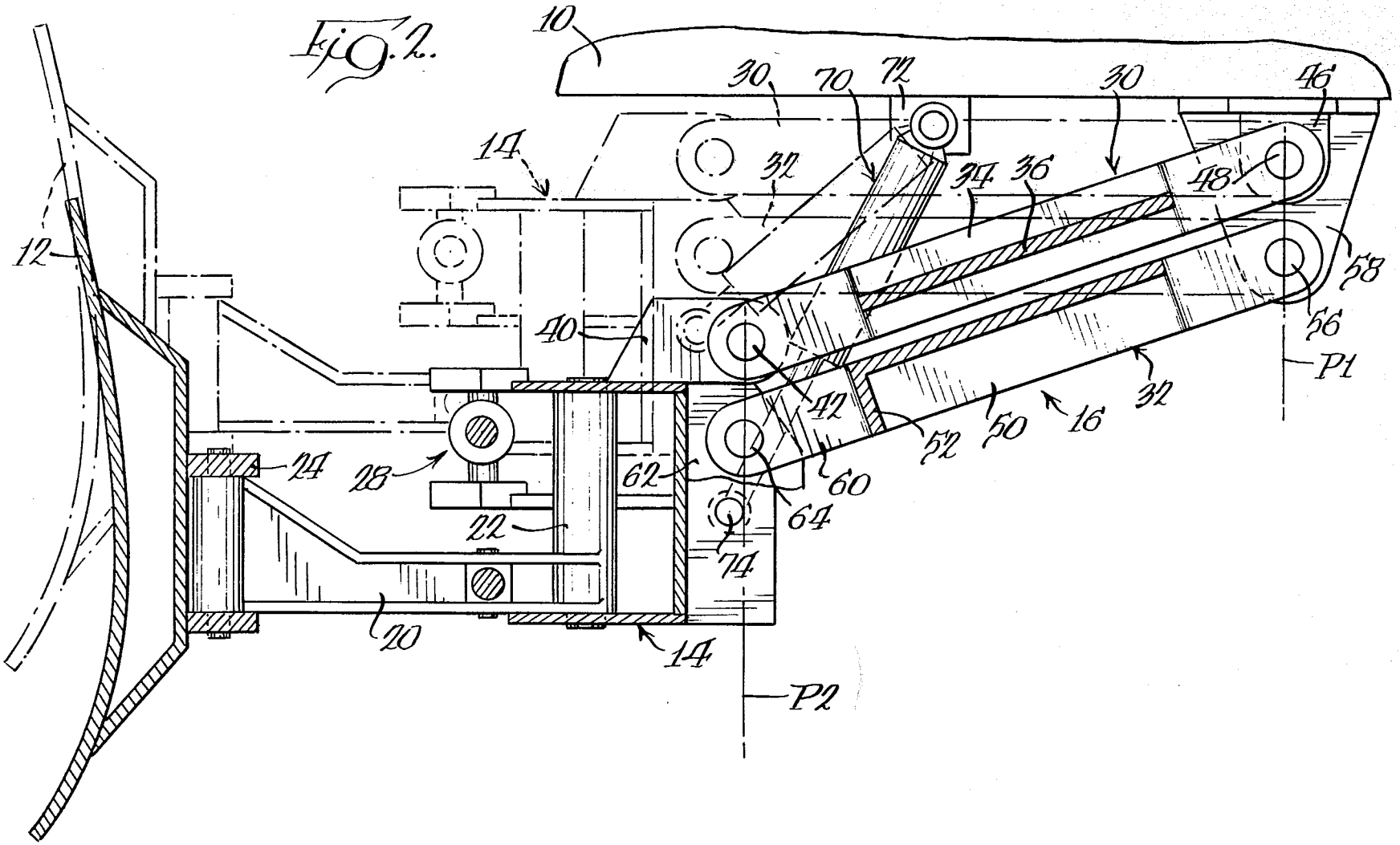
FIG. 2 is a sectional view as viewed generally along lines 2—2 of FIG. 1 showing the mounting structure in an assembled condition and supported on a vehicle frame.

FIG. 2 of the drawings generally discloses a selected portion of a vehicle frame 10 having a dozer blade 12 supported at one end thereof. The dozer blade 12 is supported on vehicle frames 10 through a dozer frame 14 and a linkage structure 16. As more clearly illustrated in FIG. 1, the support structure between dozer frame 14 and dozer blade 12 includes a pair of arms 20 each of which is pivoted at one end on dozer frame 14 through a sleeve structure 22 and at the opposite end on blade 12 through a bracket 24 having elongated openings 26 therein. Arms 20 are independently pivoted through a pair of fluid rams 28.

The mounting arrangement for dozer blade 12 on dozer frame 14 is generally similar to that disclosed in the above-mentioned Davis patent which is incorporated herein by reference. In addition, improvements to the mounting arrangement are disclosed in copending application Ser. No. 950,593, entitled "Mounting Mechanism for Angle Dozer Blade", the portions of which are consistent with the present disclosure being incorporated herein by reference.

According to the present invention, linkage structure 16 is constructed and arranged such that dozer blade 12 remains in the same general vertical reference plane while being moved between raised and lowered positions. For this purpose, linkage structure 16 consists of first and second or upper and lower links 30 and 32. Upper link 30 consists of a pair of identical members or arms 34 which are interconnected by a gusset plate 36 and cooperate to define a generally A-shaped link. The apex of the generally A-shaped link has a pair of openings 38 and is pivotally supported on a bracket 40 secured to dozer frame 14 with a pin 42 (FIG. 2) defining the pivotal connection. The respective legs of the A-shaped link 30 have openings 44 and are pivotally supported through pins 48 on transversely spaced brackets 46 that depend from vehicle frame 10. The pair of pins 48 cooperate to define a generally horizontal pivot axis for rigid link 30.

Rigid link 32 is generally trapezoidal in plan view and consists of a pair of identical arms 50 which are interconnected by a gusset plate 52. One end of each arm 50 has an opening 54 and is pivotally connected by a pin 56 to a bracket 58 depending from vehicle frame 10. Again, pivot pins 56 are located on a generally horizontal pivot axis extending transversely of vehicle frame 10.

The opposite end of rigid link 32 has a second pair of members 60 rigidly secured to an intermediate portion of gusset plate 52 and members 60 cooperate with arms 50 to define a pair of clevis structures. The respective clevis structures are pivotally supported on a pair of brackets 62 through pivot pins 64.

As most clearly illustrated in FIG. 2, vertically spaced pivot axes 48 and 56 on vehicle frame 10 are located in a substantially vertical plane P1 while pivot axes 42 and 64 are also located in a substantially vertical plane P2 that extends parallel to plane P1. Also, the links 30 and 32 are equal in length. Therefore, the reference plane P2 remains substantially vertical as dozer blade 12 is moved between the lowered and raised positions respectively shown in solid and dotted-lines in FIG. 2. Dozer blade 12 is moved between lowered and raised positions through one or two fluid rams 70 that are respectively pivoted on vehicle frame 10 through a bracket 72 and on dozer frame 14 through pivot pin 74.

With this type of linkage, the dozer blade remains in the same substantially vertical plane as it is moved between the lowered and raised positions. An additional factor and advantage derived from the particular linkage support mechanism 16 is the fact that the links 30 and 32 extend generally horizontally in the raised position for blade 12 and extend downwardly in the lowered position. Thus, in the lowered position, blade 12 is located closer to the vehicle frame than it is in the raised position to provide better visibility for the operator during operation of the blade. In addition, with the linkage positioned as shown in FIG. 2, the blade can be mounted in closer proximity to the vehicle wheels since the movement between the lowered and raised positions is along an arc causing the blade to move outwardly or away from the vehicle slightly as it is moved from the lowered to the raised position.

The trapezoidal configuration of lower link 32 maximizes the spacing between brackets 58. This arrangement has a greater capability to resist side thrusts when blade 12 is angled. The narrower opposite end of lower link 32 provides the necessary clearance for the rear tires (not shown) supporting vehicle frame 10.

Also, while it is possible to use a single fluid ram, two such fluid rams, as illustrated, are preferred. This is particularly true when the vehicle is designed to have a backhoe attached to the rear end along with the dozer blade. Under those conditions, the dozer blade and linkage are used as a stabilizer for the vehicle during use of the backhoe unit.

With the above-described arrangement, an extremely simple and inexpensive linkage can be utilized for supporting a dozer blade on a vehicle frame thereby substantially reducing the overall cost for the unit.

I claim:

1. A pivoting structure for a dozer blade supported by a dozer frame from a vehicle having pivoting support wheels, comprising:

(a) lifting means connected to said vehicle frame for raising and lowering said dozer frame and said dozer blade as a unit; and (b) mounting means for supporting said dozer frame on said vehicle frame adjacent to said pivoting support wheels, said mounting means having first and second rigid linkages of fixed equal length extending generally longitudinally on said vehicle frame and being vertically spaced from each other, said first linkage having first and second transversely spaced pivotal connections defining a first horizontal pivot axis on said vehicle frame between said support wheels, and having first and second transversely spaced pivotal connections defining a second horizontal pivot axis on said dozer frame, said first and second transversely spaced pivotal connections defining said first horizontal pivot axis being separated a greater transverse distance than said first and second spaced pivotal connections defining said second horizontal pivot axis, said first and second transversely spaced pivotal connections defining said first horizontal pivot axis and said first and second transversely spaced pivotal connections defining said second horizontal pivot being joined by a transverse plate to define a generally flat trapazoidal shaped first linkage, said transverse plate strengthening said first linkage against side thrusts when said blade is angled, said second linkage having first and second transversely spaced pivotal connections defining a first horizontal pivot axis on said vehicle frame and at least one pivotal connection defining a second horizontal pivot axis on said dozer frame, said horizontal pivot axes on said vehicle frame being substantially in the same vertical plane, said trapezoidal shape, the equal length of said first and second linkages, and the position of said vehicle frame horizontal axes having the effect of positioning said dozer frame adjacent said vehicle frame, providing clearance for the pivoting of said support wheels, and retaining said dozer frame in a substantially vertical plane when said dozer frame and said dozer blade are moved between raised and lowered positions by said lifting means.

2. In a vehicle having a vertical frame supported by wheels at least one of which pivots to steer the vehicle with a dozer blade supported on a dozer frame adjacent said at least one support steering wheel, lifting means connected between said vehicle frame and said dozer frame for raising and lowering said dozer frame and said dozer blade as a unit, and mounting means for supporting said dozer frame on said vehicle frame adjacent said wheels, the improvement of said mounting means comprising: first and second rigid linkages of fixed equal length extending generally longitudinally from said vehicle frame and being vertically spaced from each other, said first linkage having first and second transversely spaced pivotal connections defining a first horizontal pivot axis on said vehicle frame between said vehicle support wheels, and having first and second transversely spaced pivotal connections defining a second horizontal pivot axis on said dozer frame, said first and second transversely spaced pivotal connections defining said first horizontal axis being separated a greater transverse distance than said first and second transversely spaced pivotal connections defining said second horizontal axis thereby keeping the dozer blade close to the vehicle while utilizing the maximum available transverse space at the vehicle side of the first linkage, said second linkage having first and second transversely spaced pivotal connections defining a first horizontal pivot axis on said vehicle frame, and having at least one pivotal connection defining a second horizontal pivot axis on said dozer frame, the transverse spacing of the pivotal connections defining the first horizontal pivot axis on said vehicle frame for said first linkage being greater than the spacing of the pivotal connections defining the first horizontal pivot axis on said vehicle frame for said second linkage, whereby said first linkage defines the limit of the clearance provided for pivoting said at least one support steering wheel when turning said vehicle, said horizontal pivot axes on said dozer frame lying within a substantially vertical plane, said horizontal pivot axes on said dozer frame remaining in a substantially vertical plane when said dozer frame and said dozer blade are moved between raised and lowered positions by said lifting means, the transverse spacing of the pair of said first and second pivotal connections on said first linkage maintaining said dozer frame adjacent to said vehicle frame and providing clearance for the pivoting of said at least one support wheel when turning said vehicle.

3. In a vehicle having a vertical frame supported by wheels at least one of which pivots to steer the vehicle with a dozer blade supported on a dozer frame adjacent said at least one support steering wheel, lifting means connected between said vehicle frame and said dozer frame for raising and lowering said dozer frame and said dozer blade as a unit, and mounting means for supporting said dozer frame on said vehicle frame adjacent said wheels, the improvement of said mounting means comprising: first and second rigid linkages of fixed equal length extending generally longitudinally from said vehicle frame and being vertically spaced from each other, said first linkage having first and second transversely spaced pivotal connections defining a first horizontal pivot axis on said vehicle frame between said vehicle support wheels, and having first and second transversely spaced pivotal connections defining a second horizontal pivot axis on said dozer frame, said first and second transversely spaced pivotal connections defining said first horizontal axis being separated a greater transverse distance than said first and second transversely spaced pivotal connections defining said second horizontal axis thereby keeping the dozer blade close to the vehicle while utilizing the maximum available transverse space at the vehicle side of the first linkage, said second linkage having first and second transversely spaced pivotal connections defining a first horizontal pivot axis on said vehicle frame, and having at least one pivotal connection defining a second horizontal pivot axis on said dozer frame, the transverse spacing of the pivotal connections defining the first horizontal pivot axis on said vehicle frame for said first linkage being less than the spacing of the pivotal connections defining the first horizontal pivot axis on said vehicle frame for said second linkage, whereby said second linkage defines the limit of the clearance provided for pivoting said at least one support steering wheel when turning said vehicle, said horizontal pivot axes on said dozer frame lying within a substantially vertical plane, said horizontal pivot axes on said dozer frame remaining in a substantially vertical plane when said dozer frame and said dozer blade are moved between raised and lowered positions by said lifting means, the transverse spacing of the pair of said first and second pivotal connections on said first linkage maitaining said dozer frame adjacent to said vehicle frame and providing clearance for the pivoting of said at least one support wheel when turning said vehicle.

* * * * *